US007086820B1

(12) United States Patent
Blake

(10) Patent No.: US 7,086,820 B1
(45) Date of Patent: Aug. 8, 2006

(54) APPARATUS FOR THE LIFTING AND PLACEMENT OF LOADS

(76) Inventor: Daniel T. Blake, 3155 N. Cottontail Dr., P.O. Box 323, Chino Valley, AZ (US) 85323

( * ) Notice: Subject to any disclaimer, the term of this patent is extended or adjusted under 35 U.S.C. 154(b) by 59 days.

(21) Appl. No.: 10/794,913

(22) Filed: Mar. 5, 2004

Related U.S. Application Data

(60) Provisional application No. 60/454,660, filed on Mar. 17, 2003.

(51) Int. Cl.
*B66C 23/00* (2006.01)

(52) U.S. Cl. ..... 414/680; 212/176; 212/901; 254/4 R

(58) Field of Classification Search ..... 414/680, 414/589; 212/202, 204, 901, 175, 179; 254/199, 254/1, 2 R, 2 C, 3 R, 4 R
See application file for complete search history.

(56) References Cited

U.S. PATENT DOCUMENTS

| | | | | | |
|---|---|---|---|---|---|
| 866,638 | A | * | 9/1907 | Ewers | 212/202 X |
| 2,575,564 | A | * | 11/1951 | Rinkel | 414/607 |
| 3,851,777 | A | * | 12/1974 | Dilny | 414/607 |
| 4,770,304 | A | * | 9/1988 | Woods | 212/140 |
| 5,203,837 | A | * | 4/1993 | Madic et al. | 212/175 X |
| 5,217,344 | A | * | 6/1993 | Gendrault et al. | 414/729 |

* cited by examiner

*Primary Examiner*—Donald Underwood
(74) *Attorney, Agent, or Firm*—Gregory J. Nelson

(57) ABSTRACT

A portable lifting apparatus having an adjustable length vertical section with three legs thereon to engage the ground. A concave saddle is affixed to the upper end and an adjustable combination of lifting member and handle are removably attached thereto. The end of the lifting member is coupled to the object to be lifted and moved.

7 Claims, 1 Drawing Sheet

APPARATUS FOR THE LIFTING AND PLACEMENT OF LOADS

CROSS REFERENCE TO RELATED APPLICATION

The present invention is based on provisional patent application Ser. No. 60/454,660 filed Mar. 17, 2003.

BACKGROUND OF THE INVENTION

This invention relates to apparatus for facilitating the lifting and placement of loads in locations that are inaccessible to conventional equipment.

Frequently, landscaping professionals prepare plans calling for the placement or removal of mature growth in areas which are adjacent walls, fences or other mature planting. The use of conventional wheeled or track equipment is impractical. As a result, substantial hand labor is required to move large rooted shrubs and trees. Thus, the removal and planting of mature specimens without damage to the surrounding areas tends to be an expensive activity.

The use of portable lifting apparatus which can be transported to and assembled at the site is highly advantageous. The ability to provide lifting apparatus having a small footprint so as to minimize damage to the immediate area is important when operating at a highly cultivated area.

Accordingly, the present invention is concerned with a portable lifting apparatus that can be readily assembled and disassembled at the location of use. Furthermore, the individual parts of the this novel lifting mechanism can be readily carried by a single individual thereby eliminating the need for mechanized equipment to deliver the apparatus. The relatively small area of ground contact essentially eliminates any disturbance of the surrounding plantings. The apparatus is adjustable in height so that it can be used beneath the branches of larger adjacent plantings.

SUMMARY OF THE INVENTION

The present invention includes a three-legged base with the individual legs welded to a central vertical pipe. Each of the three legs has a foot of limited size that may be pinned to allow relative movement and thereby accommodate uneven ground. Also, one of the legs may be adjustable in length to allow the central vertical pipe to be substantially normal to the surface of the ground. A support member of reduced diameter having a plurality of holes therethrough to receive a securing pin is received in the central pipe. The uppermost end of the support member is provided with a saddle. The saddle is an elongated concave section of pipe welded to the end of the vertical pipe and dimensioned to receive a cylindrical lifting member. A central opening is provided in the saddle to receive a retaining pin.

An elongated section of pipe or rod is provided with a hook at one end to receive a chain and hook combination depending therefrom. The pipe has a plurality of holes therealong to receive the retaining pin when positioned in the saddle. A lifting handle of smaller dimension is inserted in the lifting member to provide the means for the operator to raise and lower the hook coupled thereto. By extending the length of the lifting handle and adjusting the positioning of the lifting member in the saddle, a significant mechanical advantage can be obtained to facilitate the lifting of the object sought to be moved or transported. As a result, the operator can adjust his position relative to the three-legged supported vertical assembly so as not to trample adjacent plantings. In addition, the upperwardly extending pipe of smaller diameter forming the support member is rotatable in the vertical pipe thereby enabling the operator to elevate a large shrub or decorative boulder and rotate the apparatus so that transporting of the large object over intervening plantings can be readily achieved.

The apparatus may be fabricated from conventional piping using standard drilling and cutting equipment with the 3-legged base being formed by typical welding practices. Thus, the device is relatively inexpensive to fabricate. The nesting of the various lengths of pipe in both the vertical sections and the lifting handle enable the assembly and disassembly to be quickly and easily accomplished by an individual operator. Thus, the device is well suited for use by individual nursery men and gardeners in developing or transforming existing plantings.

DESCRIPTION OF THE PREFERRED EMBODIMENT

Figures 1, 2, 3:
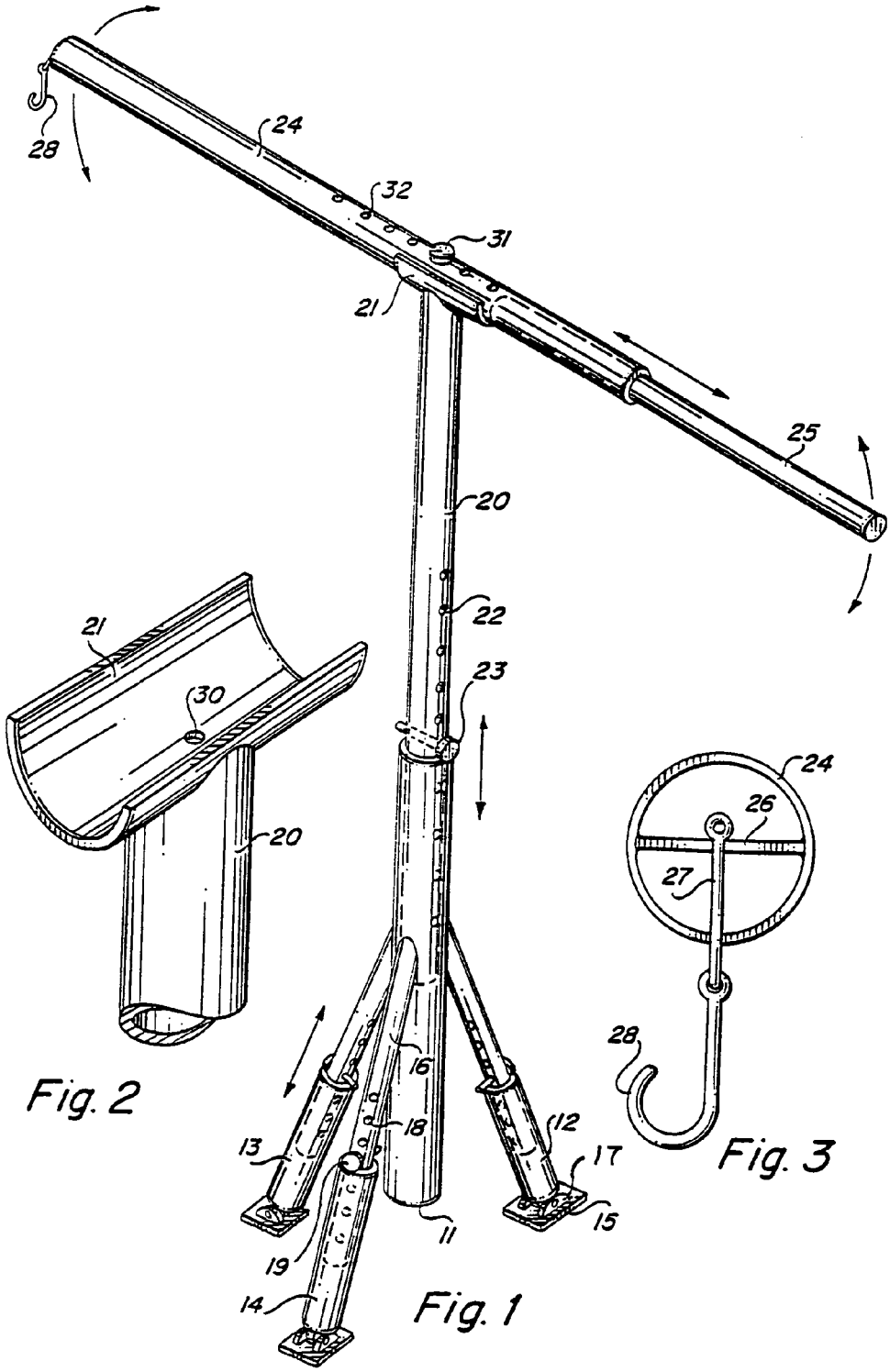
FIG. 1—The invention is shown in the accompanying drawing which is a partial side view of the apparatus.
FIG. 2 is a view in perspective of the saddle affixed to the adjustable height central support member.
FIG. 3 is an end view of the lifting member.

Referring now to FIG. 1, the apparatus is shown assembled in an operating position. The central hollow vertical section 11 is supported as shown above ground by three legs 12, 13 and 14. The legs are welded to the outside surface of the central vertical section. Each leg is provided with a foot 15 which may be secured thereto by laterally extending 17 to permit movement relative to the respective leg. The moveable foot enables the leg to more readily accommodate itself to the underlying surface. To assist in maintaining the central vertical section 11 in the upright position, at least one leg 14 is shown adjustable. The adjustable leg includes a smaller diameter section 16 having a plurality of openings 18 which receive a locking pin 19 therein.

An adjustable length central support member 20 is received in the central vertical section 11. The central support member is provided with a plurality of openings 22 which slidably receive a locking pin 23 therethrough. At the upper end of the support member 20 is a saddle 21 shown in FIG. 2 as a curved concave support positioned transverse to the support member 20. The saddle containing a central opening 30 is welded to the free end of the support member. The saddle supports and aligns the lifting member 24 therein. As seen in FIG. 3, the end of lifting member 24 is provided with a crossbar 26 welded thereto. A coupler 27 is secured to the crossbar and is provided with lifting hook 28. An extended lifting handle 25 of smaller diameter than the lifting member 24 is slidably received in the end of the lifting member. The length of the lifting handle 25 determines in part the mechanical advantage available to the operator when moving the lifting handle in the direction of the arrow shown in FIG. 1. A plurality of openings 32 are longitudinally spaced along lifting member 24 to receiving retaining pin 31 and align the lifting member in the saddle 21. The distance between the saddle and hook 28 determines the mechanical advantage available to the operator.

In operation, the boulder, tree stump, plant container or other heavy object is secured by a chain or cable surrounding its surface with the free end of the chain or cable brought to the lifting hook 28. The central vertical section 11 with the three legs attached thereto is then approximately positioned near the boulder in a free area which is not disturbing of surrounding foliage and provides sufficient clearance for operation. Next, the central support member with affixed saddle is positioned at the appropriate height and pin 23 is inserted therethrough. The lifting member is placed on the saddle and the retaining pin 31 is inserted into the saddle opening. Next, the handle is inserted and pressure in the downward direction exerted on the free end of the lifting handle 25. When the object clears the ground, a rotation of the central support member in the central vertical section 11 can be accomplished by lateral pressure on the lifting handle 25. As a result, the object is transported to a working area without disturbing surrounding plantings. Furthermore, the mechanical advantage provided by the lifting handle is available to facilitate the task for the operator.

While the foregoing description has referred to a specific embodiment of the invention, it is to be noted that modifications and variations may be made therein without departing from the scope of the invention.

What is claimed is:

1. Portable apparatus for lifting and transporting a load which comprises:

a) an elongated central section;

b) at least three legs affixed to the central section for supporting the central section in an upright position, means for adjusting the length of at least one of said legs;

c) a central support member for adjustably engaging the central section having an upper end;

d) fastening means for securing the central section to the central support member in the upright position;

e) a receiving saddle having a transverse convex section affixed to the upper end of the central support member;

f) a lifting member received in the saddle and having a free end and defining a bore at an intermediate location, said saddle supporting and aligning said lifting member;

g) engaging means attached to said free end for coupling to the load;

h) a handle engaging the lifting member, the application of force to the handle lifting and transporting the load;

i) said saddle defining a central opening; and j) a retaining pin vertically extending through the bore in the lifting member into the central opening.

2. The portable apparatus for lifting and transporting a load of claim 1 wherein said elongated central section is hollow and said central support member is dimensioned to be received therein.

3. The portable apparatus for lifting and transporting a load of claim 1 further comprising a movable foot pivotally attached to each of the at least three legs.

4. The portable apparatus for lifting and transporting a load of claim 3 wherein said central support member has a plurality of spaced holes for receiving a pin therethrough whereby the distance between the saddle and the central section is adjustable.

5. The portable apparatus for lifting and transporting a load of claim 1 wherein said handle is telescopically received in said lifting member and variable in length.

6. The portable apparatus for lifting and a load of claim 5 wherein the engaging means comprises an attachment bar affixed at said free end.

7. Portable apparatus for lifting and transporting a load which comprises:

a) an elongated central hollow section;

b) at least three legs affixed to the central section for supporting the section in an upright position, adjusting means associated with at least one of said legs for adjusting the length thereof to stabilize and level the apparatus;

c) a central support member having a lower end adjustably receiving the central section and an upper end;

d) fastening means for adjustably securing the central section to the central support member in the upright position;

e) a receiving saddle having a transverse convex section affixed to the upper end of the central support member;

f) a lifting member received in the saddle and having opposite ends and defining a bore at an intermediate location, said saddle supporting and aligning said lifting member, said lifting member including an attachment bar affixed at the one end thereof;

g) engaging means attached to said free end for coupling to a load;

h) a handle adjustably engaging the lifting member at the other end thereof whereby the length thereof is adjustable, the application of manual force to the handle lifting and transporting the load;

i) a central opening in the saddle; and j) a retaining pin extending vertically through the lifting member into the central opening in the saddle whereby the saddle supports and aligns the lifting member restricting downward movement of the lifting member when a load and a manual force is applied.

* * * * *